US011134810B1

(12) United States Patent
Abrams et al.

(10) Patent No.: US 11,134,810 B1
(45) Date of Patent: Oct. 5, 2021

(54) DRAIN ARRANGEMENT FOR SHOWER DOOR

(71) Applicant: 310 Tempering, Jeffersontown, KY (US)

(72) Inventors: Greg Lee Abrams, Louisville, KY (US); Christopher Andrew Murphy, Louisville, KY (US)

(73) Assignee: 310 Tempering, Jeffersontown, KY (US)

( * ) Notice: Subject to any disclaimer, the term of this patent is extended or adjusted under 35 U.S.C. 154(b) by 0 days.

(21) Appl. No.: 16/840,717

(22) Filed: Apr. 6, 2020

(51) Int. Cl.
*A47K 3/30* (2006.01)
*E06B 7/14* (2006.01)
*E06B 7/23* (2006.01)

(52) U.S. Cl.
CPC ..... *A47K 3/302* (2013.01); *E06B 7/14* (2013.01); *E06B 7/2316* (2013.01); *A47K 2003/305* (2013.01)

(58) Field of Classification Search
CPC .... A47K 3/302; A47K 2003/305; E06B 7/14; E06B 7/2316; E06B 2007/145
See application file for complete search history.

(56) References Cited

U.S. PATENT DOCUMENTS

| | | | | | |
|---|---|---|---|---|---|
| 1,944,440 | A * | 1/1934 | Lehman | A47K 3/36 | 49/489.1 |
| 2,032,180 | A * | 2/1936 | Mccord | A47K 3/30 | 4/581 |
| 3,449,770 | A * | 6/1969 | Casebolt | A47K 3/36 | 4/607 |
| 3,504,456 | A * | 4/1970 | Claud, Jr. | E06B 7/16 | 49/470 |
| 5,023,965 | A * | 6/1991 | Reichel | A47K 3/36 | 4/557 |
| 5,493,738 | A * | 2/1996 | Sanderson | A47K 3/30 | 4/609 |
| 8,505,131 | B2 * | 8/2013 | Doolittle | E03F 5/0408 | 4/613 |
| 2016/0367082 | A1 * | 12/2016 | Whitaker | A47K 3/36 | |

FOREIGN PATENT DOCUMENTS

| | | | | |
|---|---|---|---|---|
| EP | 0853914 | * | 7/1998 | A47K 3/36 |

* cited by examiner

*Primary Examiner* — J C Jacyna
(74) *Attorney, Agent, or Firm* — Duncan Galloway Egan Greenwald PLLC; Theresa Camoriano; Guillermo Camoriano

(57) ABSTRACT

A shower door sweep includes a bottom sweep element which defines an outer trough and an inner trough. The outer trough is sized to receive the bottom edge of a shower door. A drain channel element is inserted into the inner trough of the bottom sweep element and collects water droplets sliding down along the door wall and routes them to the hinge-end of the shower door even when the door is in the open position.

6 Claims, 7 Drawing Sheets

DRAIN ARRANGEMENT FOR SHOWER DOOR

BACKGROUND

The present invention relates to a drain arrangement for a shower door. More particularly, it relates to a door sweep for a shower door designed to collect the water sliding down along the door and drain it back into the shower enclosure.

Prior art door sweeps for a shower door have been difficult to install and have required skill on the part of the installer to ensure that the sweep has the proper angle to drain the water back into the shower enclosure.

SUMMARY

The present invention provides a door sweep that is easy to install and that has an insert with a preset angle to ensure that water is properly collected and drained from the shower door back into the enclosure. The insert may be reversed so it works properly regardless of the side on which the shower door is hinged.

DESCRIPTION

Figure 1:
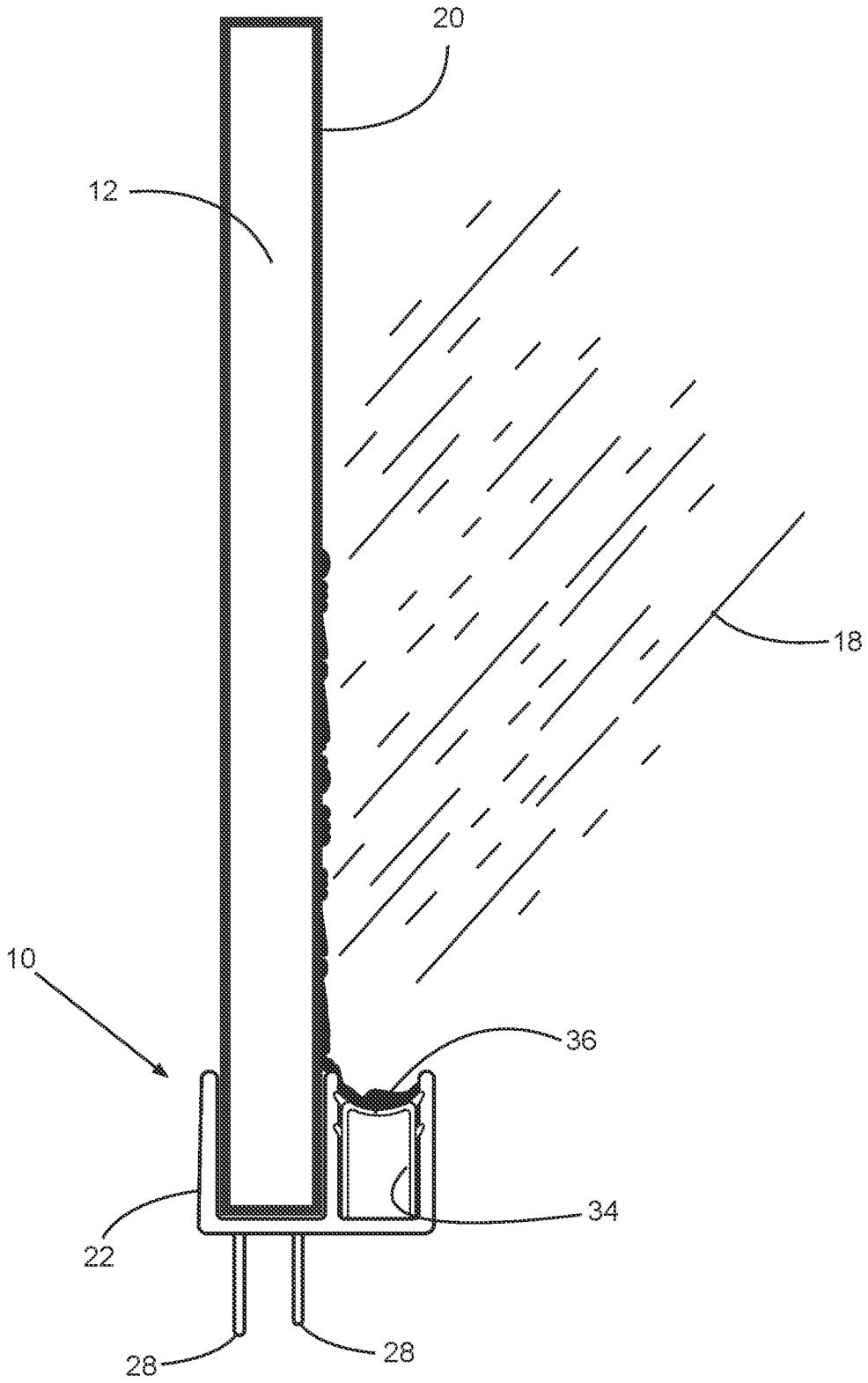
FIG. 1 is an end view of a shower door with an example of a door sweep made in accordance with the present invention.
Figure 2:
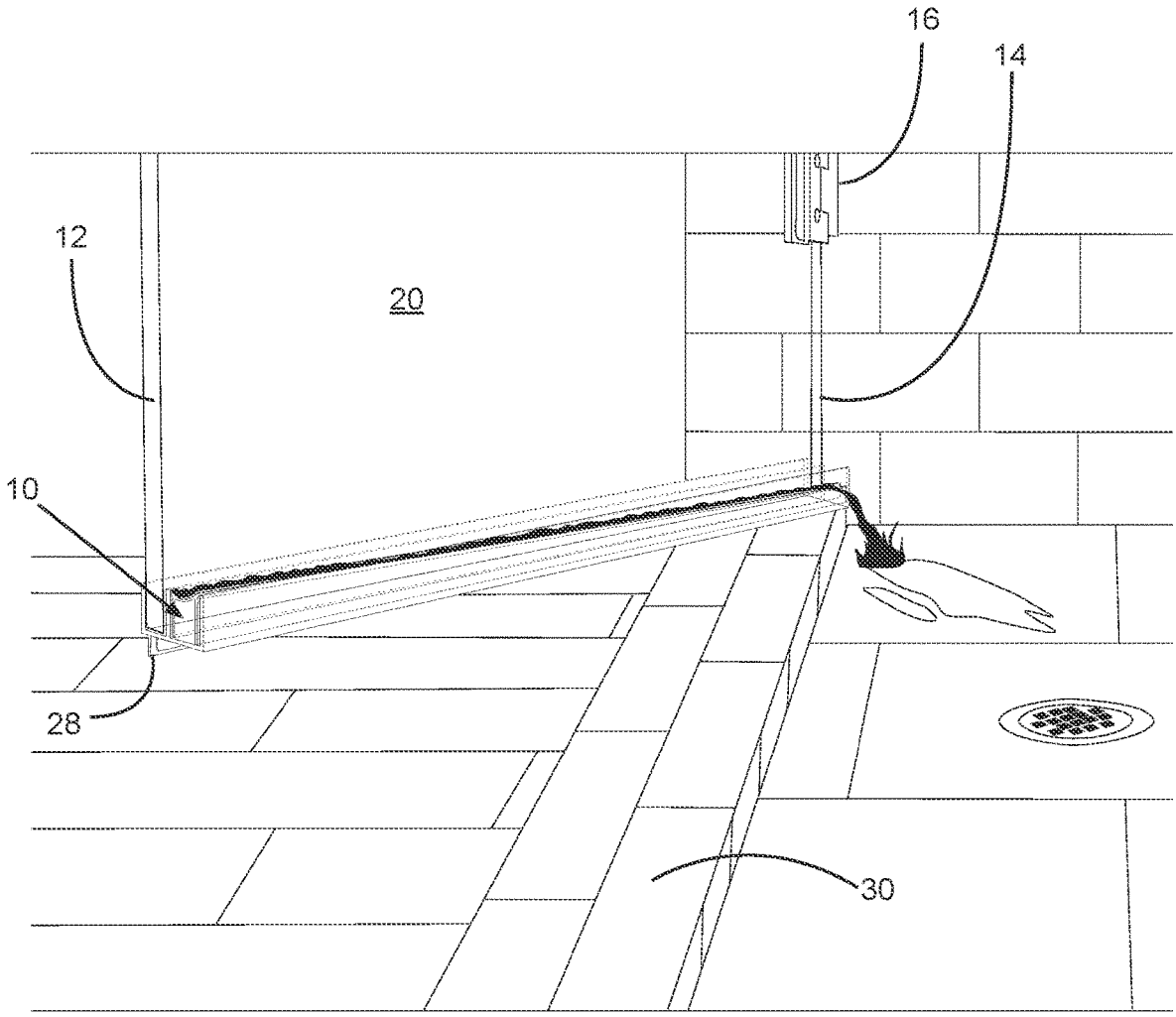
FIG. 2 is a rear perspective view of the shower door and door sweep of FIG. 1, but with the door open, showing water droplets remaining on the door which slide down and are collected by the drain and routed back into the shower enclosure.
Figure 3:
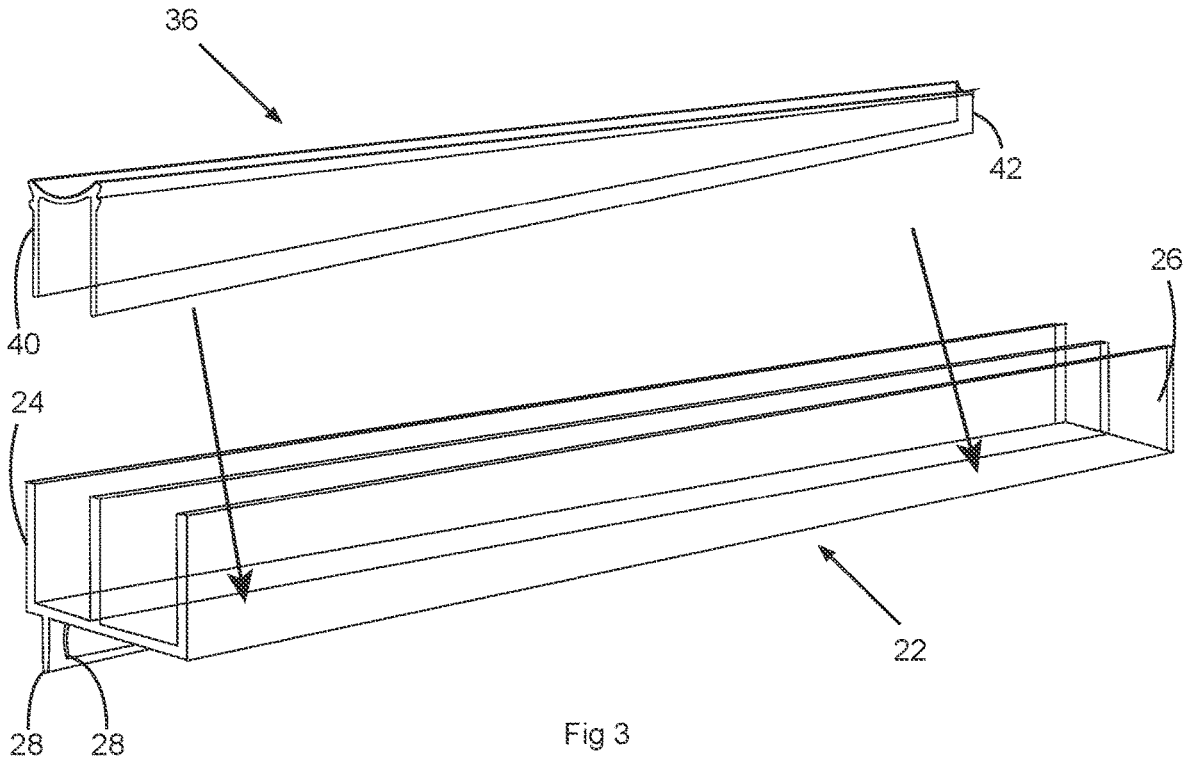
FIG. 3 is an exploded, rear perspective view of the door sweep of FIGS. 1 and 2.
Figure 4:
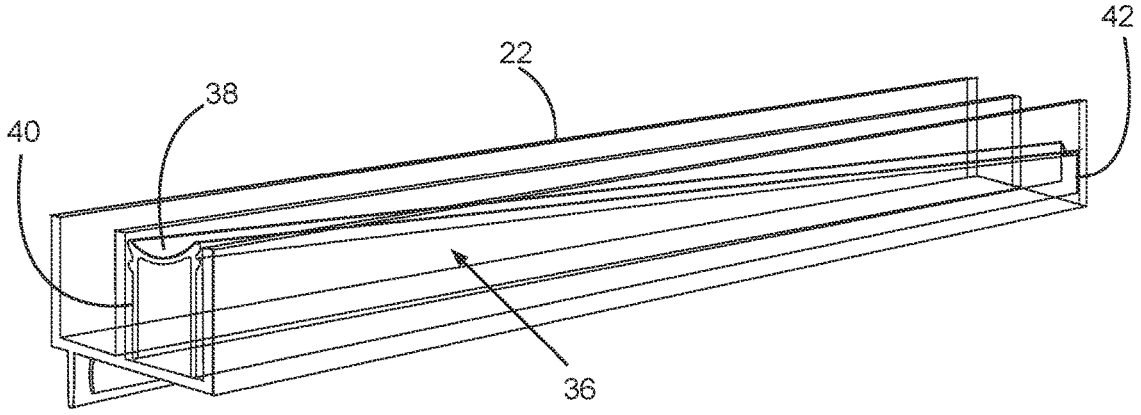
FIG. 4 is an assembled rear perspective view of the door sweep of FIGS. 1-3, with the bottom sweep housing shown faintly to clearly differentiate it from the drain channel itself.

FIGS. 1-7 show an example of a shower door sweep 10 made in accordance with the present invention. Referring to FIGS. 1 and 2, a shower door 12 is supported for swinging motion at a first vertical edge 14 by a plurality of hinges 16. When the door 12 is closed and the shower is running, water 18 is sprayed onto the inside surface 20 of the door 12 and slides down the inner surface of the door. This water falls into the door sweep 10, which catches them and routes them to the hinged side of the door 12 and down into the shower enclosure. Even after the water is shut off and the door is swung open, water droplets on the inside surface 20 of the door 12 continue to slide down to the bottom of the door 12. These water droplets also fall into the door sweep 10, which catches them and routes them to the hinged side of the door 12 and down into the shower enclosure (as shown in FIG. 2) as explained in more detail below.

Referring to FIGS. 3-7, this example of a door sweep 10 is a two-piece arrangement. The first piece is an elongated element which we will refer to as a bottom sweep 22. The bottom sweep 22 has a double "U"-shaped profile, open at both left and right ends 24, 26. The double "U"-shaped profile is the same for the full length of the bottom sweep 22. The bottom sweep 22 may be manufactured as a single extrusion, which is then cut to the desired length for the specific installation, such as 36 inches long for a standard 36 inch wide shower door. This particular bottom sweep 22 is made of extruded polycarbonate, so it can be clear and does not distract from a glass shower door.

The bottom of the bottom sweep 22 includes one or more flexible extensions 28 designed to sweep and seal against the threshold of the shower door to prevent water seepage from inside the shower enclosure. FIG. 2 shows the flexible extensions 28 in contact with the floor outside the shower enclosure to provide a seal.

Figure 5:
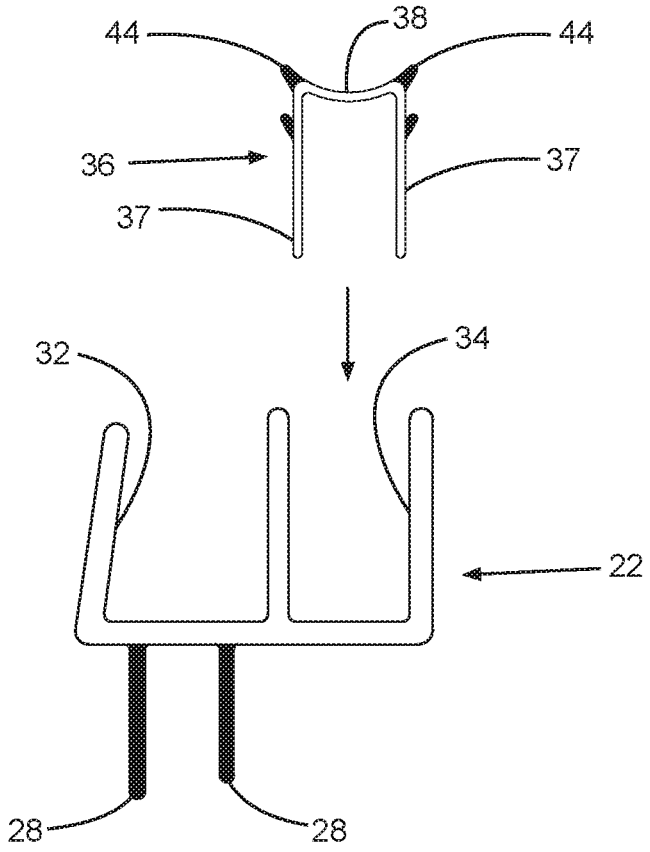
FIG. 5 is an exploded end view of the door sweep of FIG. 3.
Figure 6:
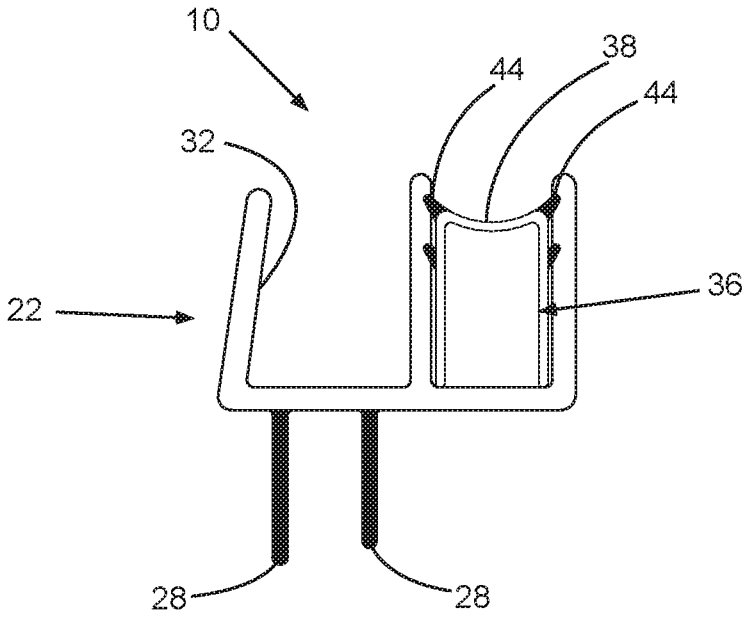
FIG. 6 is an end view of the assembled door sweep of FIG. 4.

As best appreciated in FIGS. 5 and 6, the double "U"-shaped profile of the bottom sweep 22 defines outer and inner troughs 32, 34, which open upwardly. The outer trough 32 is sized to receive the bottom edge of the shower door and to fit snugly against the bottom edge, with the door abutting the inner bottom surface of the outer trough 32. The width of the outer trough 32 is sized and slightly tapered inwardly from the bottom to the top to enable the bottom sweep 22 to be pushed onto the bottom edge of the shower door 12 and secured by friction alone.

To install the bottom sweep 22 onto the door 12, the user simply opens the shower door 12 and slides the bottom sweep 22 onto the bottom edge of the door 12 from the free edge of the door 12 toward the hinged edge 14. At this point, the bottom of the door 12 rests on the inner bottom surface of the outer trough 32. The inner bottom surface of the inner trough 34 is at the same elevation as the inner bottom surface of the outer trough 32. The installer taps the bottom sweep 22 onto the door so that the ends of the bottom sweep 22 are flush with the left and right edges of the door 12.

The inner trough 34 of the bottom sweep 22 is "cantilevered" off of the outer trough 32 and is the same length as the outer trough 32. The bottom sweep 22 is mounted onto the door 12 with the inner trough 34 on the inside of the door 12, facing the inside of the shower enclosure, as seen in FIGS. 1 and 2.

The second piece of the door sweep 10 is also an elongated element referred to as a drain channel 36. The drain channel 36 is received in the inner trough 34 of the bottom sweep 22.

The drain channel 36 has inner and outer legs 37 as shown in FIG. 5, and it has a continuous, concave top surface 38 which is open at both ends 40, 42. The profile of the drain channel 36 is not the same for the full length. Instead, the profiles of the legs 37 are tapered from one end to the other so that, when the legs 37 of the drain channel 36 rest on the bottom of the inner trough 34 (i.e., when the drain channel 36 is fully inserted into the inner trough 34), the top surface 38 of the drain channel 36 is at a higher elevation on one end and tapers to a lower elevation at the other end.

The drain channel 36 may be manufactured by any desired means. In this particular embodiment, the drain channel 36 was manufactured as a single polycarbonate extrusion, and the bottom edges of the legs 37 were then cut to form the taper. The extrusion also was cut to the desired length for the specific installation.

It is preferred that the drain channel 36 taper uniformly from its first end 40 to its second end 42 and that the maximum height of the drain channel 36 (the height at its first end 40) be less than or equal to the depth of the inner trough 34 of the bottom sweep 22 so that the concave top surface 38 is inside the inner trough 34.

The drain channel 36 defines short nubs or projections 44 extending the full length of the drain channel 36 on both the front and rear surfaces of the drain channel 36. These nubs 44 seal the front and rear surfaces of the drain channel 36 against the inner trough 34 of the bottom sweep 22 and hold the drain channel 36 in place within the inner trough 34 without the need for additional securing mechanisms.

Figure 7:
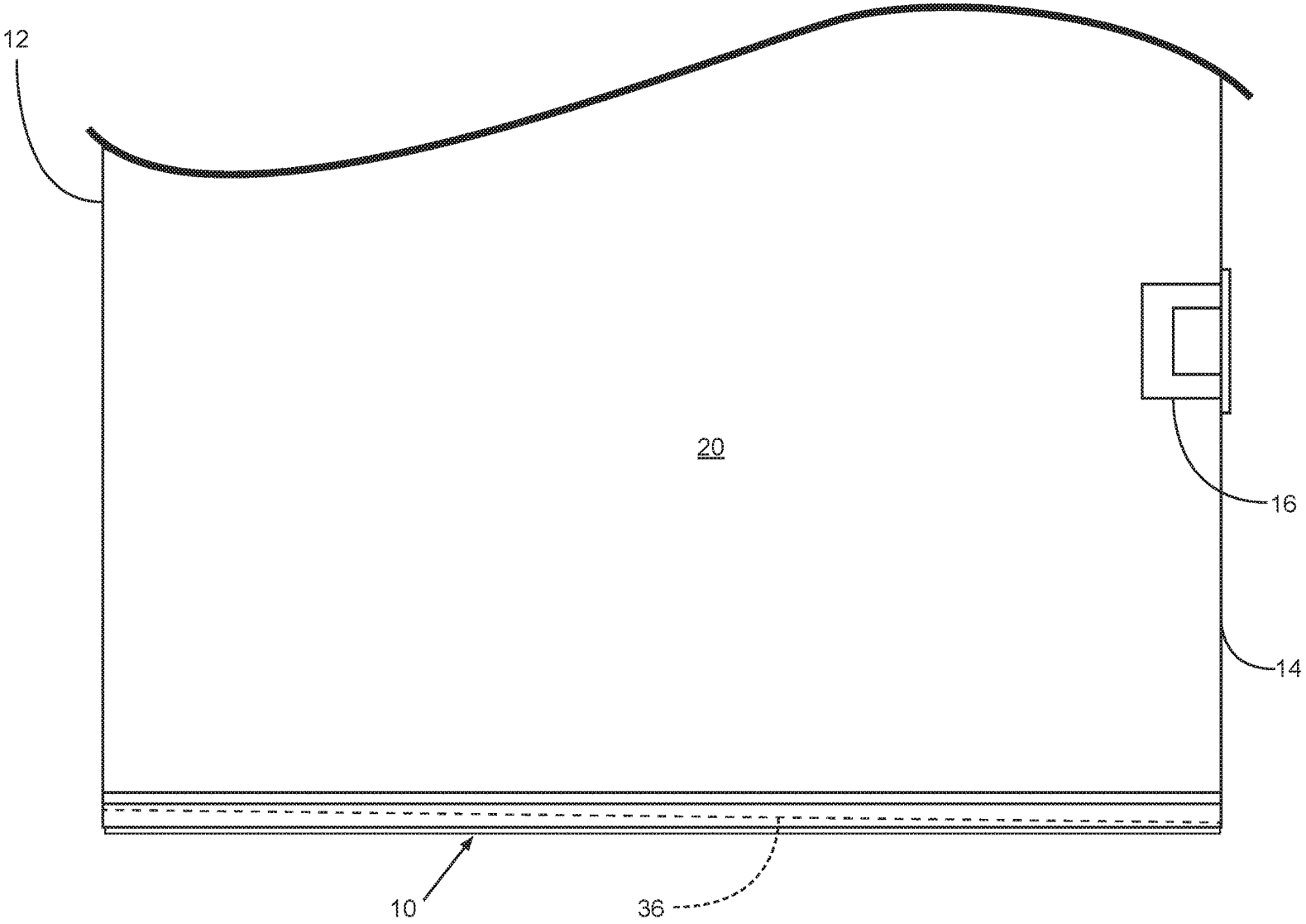
FIG. 7 is a rear view of the assembled door sweep of FIGS. 1-6 mounted on the bottom of a door that is broken away.
Figure 8:
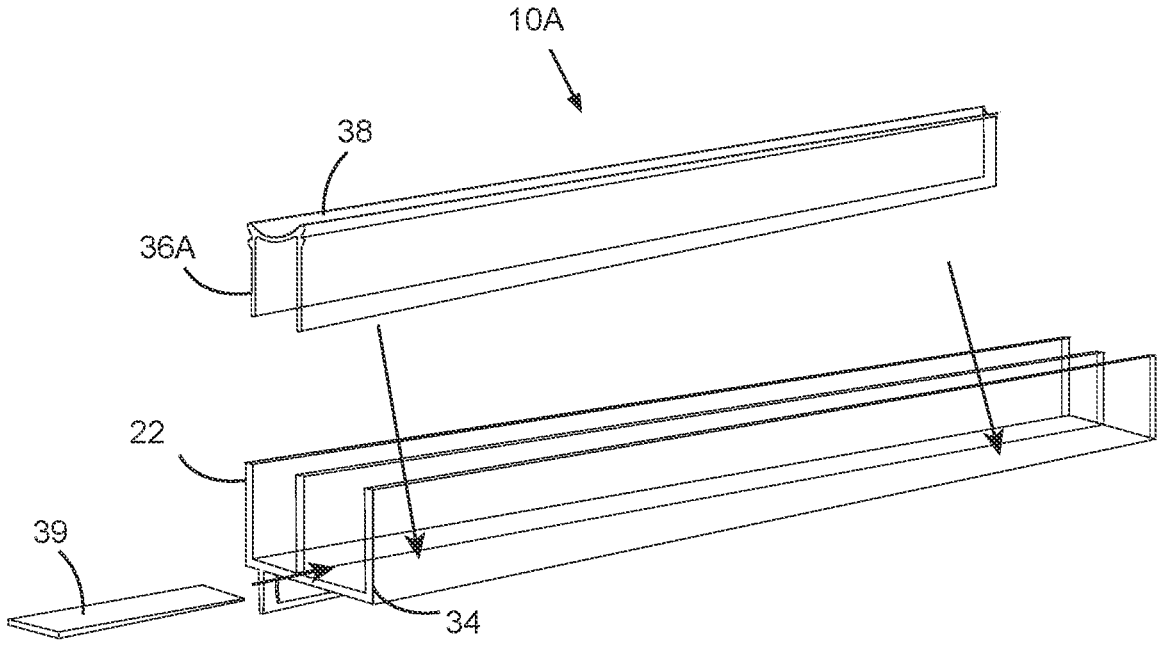
FIG. 8 is an exploded perspective view of an alternate embodiment, similar to FIG. 3 and including a shim.
Figure 9:
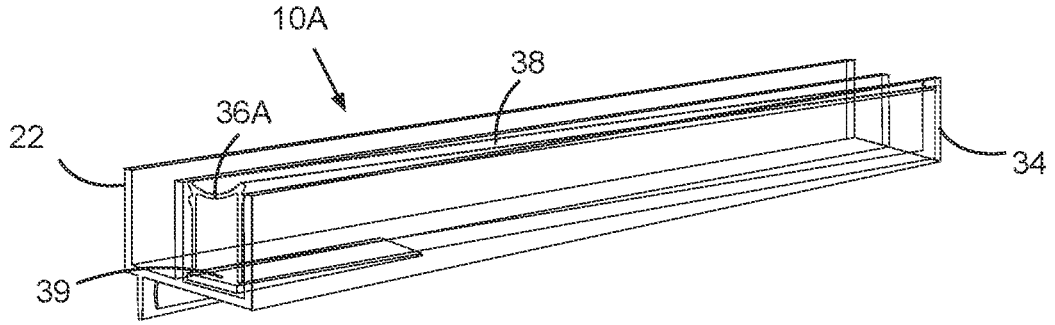
FIG. 9 is a rear perspective view of the assembled embodiment of FIG. 8.
Figure 10:
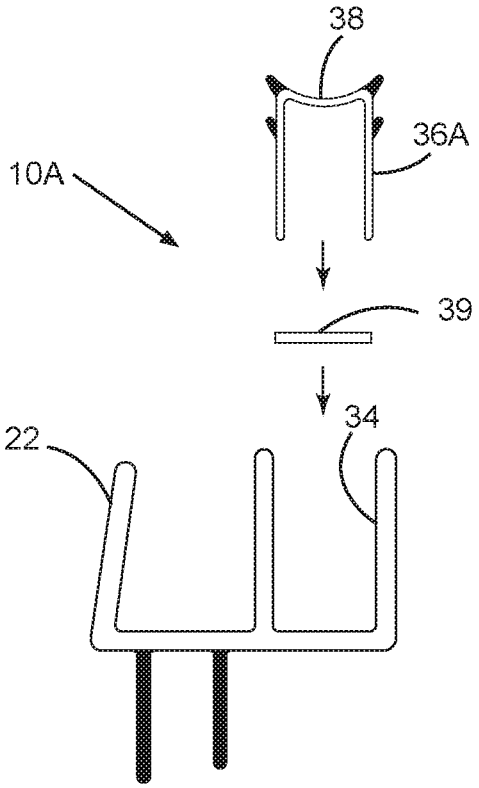
FIG. 10 is an exploded end view of the embodiment of FIG. 8.
Figure 11:
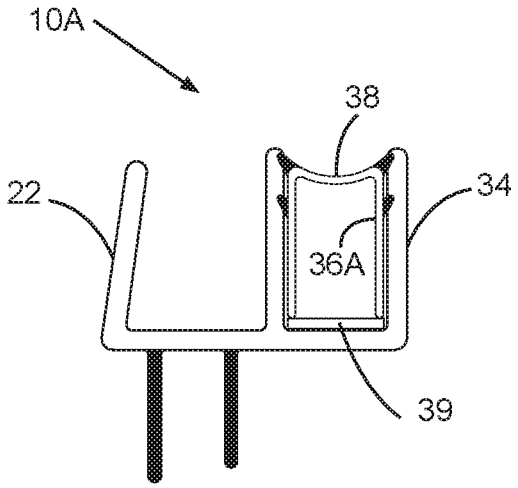
FIG. 11 is an end view of the assembled embodiment of FIG. 8.

The drain channel 36 is mounted onto the inner trough 34 of the bottom sweep 22 so that the lower elevation end 42 of the drain channel 36 is at the hinge edge 14 of the door 12, as shown in FIGS. 2 and 7. Any water that slides down along the shower door 12 is collected on the concave top surface 38 of the drain channel 36, and the tapered elevation of the top surface 38 routes the water downwardly toward the hinged edge 14 of the door 12. This ensures that the water is returned to the shower enclosure whether the door 12 is open or closed.

An advantage of this arrangement is that the installer does not have to set the angle of taper of the drain channel 36. The angle of taper is already set by the cooperating shapes of the inner surface of the inner channel 34 of the bottom sweep 22 and the drain channel 36. Another advantage of this arrangement is that the drain channel 36 may be reversed so its lower elevation top surface 38 may be installed on either the left side or the right side, which allows the same drain channel 36 to be used regardless of which side of the door 12 is hinged.

If the hinged edge of the door 12 is opposite that shown in FIG. 2, the user mounts the bottom sweep 22 the same way but reverses the drain channel 36 before inserting it into the inner trough 34, so that its lower elevation end 42 is reversed from what is shown in FIG. 2 (namely, so that, once again, the lower elevation end 42 is at the hinged edge of the door 12, and the water is collected and drained to the hinged edge of the door 12).

FIGS. 8-11 show an alternative embodiment of a door sweep arrangement 10A, which is similar to the first embodiment, except that the drain channel 36A itself is not tapered from one end to the other, and instead a shim 39 is inserted between the drain channel 36A and the bottom of the inner trough 34 to make the top surface 38 of the drain channel 36A taper from a higher elevation at the end with the shim 39 to a lower elevation at the end without the shim 39 when the drain channel is fully inserted into the inner trough 34. It is preferred that the shim 39 have a flat bottom surface and a tapered top surface. The shim 39 may be much shorter than the sweep 22 and the drain channel 36A. The shim 39 may be made of the same material as the sweep 22 and the drain channel 36A, preferably being transparent.

It will be obvious to those skilled in the art that modifications may be made to the embodiments described above without departing from the scope of the present invention as claimed.

What is claimed is:

1. A sweep for a shower door, comprising:

a first elongated element having inner and outer troughs that open upwardly and first and second ends, wherein said outer trough has a horizontal bottom surface; and a removable elongated drain channel having a concave top surface and first and second ends, wherein, when said removable drain channel is fully inserted into said inner trough, with said concave top surface inside said inner trough, said concave top surface tapers downwardly from a higher elevation at said first end to a lower elevation at said second end.

2. A sweep for a shower door as recited in claim 1, wherein said elongated drain channel has a front surface and a rear surface and includes sealing nubs extending along its front surface and its rear surface from its first end to its second end to form a seal between the front and rear surfaces of said elongated drain channel and said inner trough when said elongated drain channel is inserted into said inner trough.

3. A sweep for a shower door as recited in claim 2, wherein said drain channel itself has a height that is tapered from its first end to its second end.

4. A sweep for a shower door as recited in claim 2, wherein said inner trough has a tapered bottom surface, with a higher elevation at said first end and a lower elevation at said second end.

5. A sweep for a shower door as recited in claim 4, wherein said tapered bottom surface of said inner trough includes a shim at said first end of said inner trough.

6. A sweep for a shower door as recited in claim 1, wherein said drain channel is reversible, so it can be removed from said inner channel, rotated, and fully inserted into said inner channel so that said concave top surface tapers downwardly from a higher elevation at said second end to a lower elevation at said first end.

* * * * *